US006953489B2

(12) United States Patent
Choi et al.

(10) Patent No.: US 6,953,489 B2
(45) Date of Patent: Oct. 11, 2005

(54) CAPSULATED ABRASIVE COMPOSITION AND POLISHING PAD USING THE SAME

(75) Inventors: Yong Soo Choi, Sungnam-shi (KR); Hyung Soon Park, Ichon-shi (KR)

(73) Assignee: Hynix Semiconductor Inc., Kyoungki-do (KR)

( * ) Notice: Subject to any disclaimer, the term of this patent is extended or adjusted under 35 U.S.C. 154(b) by 184 days.

(21) Appl. No.: 10/331,252

(22) Filed: Dec. 30, 2002

(65) Prior Publication Data

US 2003/0139127 A1 Jul. 24, 2003

(30) Foreign Application Priority Data

Dec. 31, 2001 (KR) ..... 2001-89123

(51) Int. Cl.[7] ..... B24D 11/00

(52) U.S. Cl. ..... 51/298; 51/307; 51/308; 51/309; 51/293

(58) Field of Search ..... 51/298, 293, 307, 51/308, 309; 438/692, 693; 451/526

(56) References Cited

U.S. PATENT DOCUMENTS 5,014,468 A * 5/1991 Ravipati et al. ..... 51/295
6,435,947 B2 8/2002 Mueller et al. ..... 451/41
6,439,965 B1 8/2002 Ichino et al. ..... 451/36
6,439,986 B1 8/2002 Myoung et al. ..... 451/443
6,454,634 B1 9/2002 James et al. ..... 451/41
6,458,023 B1 10/2002 Moon ..... 451/526
6,461,226 B1 10/2002 Yi ..... 451/41
6,663,480 B2 * 12/2003 Jeong et al. ..... 451/526
6,685,540 B2 * 2/2004 Cherian et al. ..... 451/41

FOREIGN PATENT DOCUMENTS

KR 2001-49979 6/2001
KR 2001-111548 12/2001

OTHER PUBLICATIONS

Communication from Korean Intellectual Property Office dated Feb. 27, 2004 with translation (4 pages).

* cited by examiner

*Primary Examiner*—Michael Marcheschi
(74) *Attorney, Agent, or Firm*—Marshall, Gerstein & Borun LLP

(57) ABSTRACT

Capsulated abrasive compositions and a polishing pad using the same. More specifically, a polishing pad coated with compositions, which contain a capsulated abrasive, thereby used for planarizing interlayer insulating film formed on a semiconductor substrate by chemical mechanical polishing.

11 Claims, 2 Drawing Sheets

CAPSULATED ABRASIVE COMPOSITION AND POLISHING PAD USING THE SAME

BACKGROUND

1. Technical Field

Capsulated abrasive compositions and polishing pads using the same are disclosed. More specifically, a polishing pad coated with compositions containing a capsulated abrasive that are used for planarizing interlayer insulating films formed on semiconductor substrates by chemical mechanical polishing (hereinafter, abbreviated to 'CMP').

2. Description of the Related Art

In general, a CMP process is performed by combining a chemical reaction and a mechanical reaction. The chemical reaction is between the etching solution contained in the slurry and the film to be polished. In the mechanical reaction, a force applied by a polishing pad is transmitted to the abrasive in the slurry, and the abrasive mechanically grinds the chemically reacted film.

In a conventional CMP process, a rotating polishing pad and a wafer are directly contacted under pressure, and the slurry containing the abrasive and the etching solution is provided to the interface between the pad and wafer. That is, the surface of the wafer is planarized by chemical mechanical polishing.

Accordingly, a polishing speed, and a defect and erosion of the polished surface are varied due to the abrasive and the etching solution which are contained in the CMP slurry.

The conventional CMP process using the slurry containing the abrasive requires about 200~300 mL/min of slurry per wafer, and only about 20~30% thereof is actually used in the CMP process; the remainder is wasted.

And, when the CMP process using conventional slurry is carried out, it generates waste solution containing the polishing by-product, the abrasive and the etching solution.

For example, when CMP process is applied about 3~4 times per wafer, about 2~4 L of CMP slurry is used, and the amount of waste solution generated by CMP process is about 2000~4000 L per one thousand wafers. As a result, additional costs are required to treat the waste solution.

However it is difficult to reduce the amount of the slurry for the CMP process. Moreover, using reduced amounts of slurry lowers acceptable polishing speed.

As long as conventional overpolishing is applied to the CMP process, there are problems of dishing and erosion due to an irregular distribution of pressure between different materials of the device being processed, the content of the abrasive and the influence of the oxidizing agent containing the metal CMP slurry.

SUMMARY OF THE DISCLOSURE

A capsulated abrasive composition and a polishing pad coated with the above composition are disclosed. The migration of the abrasive is limited by using a pad coated with the capsulated abrasive composition instead of a CMP slurry containing a free abrasive.

In addition, a method of CMP using the above polishing pad is disclosed.

A capsulated abrasive composition; a polishing pad coated with the above composition; and a method of CMP using the above polishing pad are all disclosed.

BRIEF DESCRIPTION OF THE DRAWINGS

The disclosure will become better understood with reference to the accompanying drawings that are given only by way of illustration and thus are not limitative of the disclosure, wherein.

DETAILED DESCRIPTION OF THE PRESENTLY PREFERRED EMBODIMENTS

A polishing pad is manufactured by coating a capsulated abrasive composition onto the pad.

Figure 1:
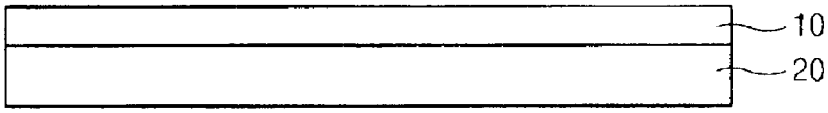
FIG. 1 is a cross-sectional view illustrating a polishing pad according to the disclosure.

The polishing pad comprises (a) a base pad 20; and (b) an abrasive layer 10, formed on the base pad 20 as shown in FIG. 1. The base pad 20 can be consisting of a soft layer and/or a hard layer, preferably the soft layer which provides uniformity and the hard layer which provides planarity.

Figure 2:
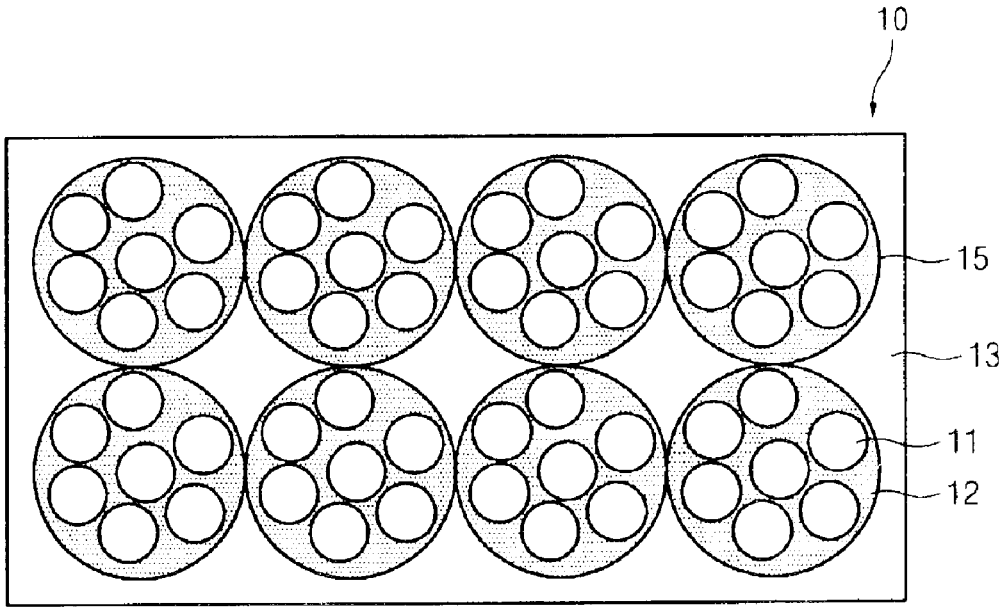
FIG. 2 is a plan view illustrating an abrasive layer containing a capsulated abrasive coated to the polishing pad of the disclosure.

The abrasive layer 10 comprises a second binder 13 and the capsulated abrasive 15 impregnated in the second layer 13, and the capsulated abrasive 15 is an abrasive 11 capsulated with a first binder 12 as shown in FIG. 2.

The first binder 12 is dissolved in an etching solution. For example, polyethylene glycol, polyvinyl alcohol or cellulose type resin, which have an excellent solubility to water; or acrylate type resin or styrene-acrylate type resin, which are dissolved in alkaline solution, can be used for the first binder 12.

General abrasive such as fumed silica, colloidal silica, $CeO_2$, $MnO_2$ or $Al_2O_3$ can be used for the abrasive 11.

The second binder 13 comprises a material swelled by a contact pressure between a wafer to be polished and a polishing pad and by an interaction of the etching solution and the polishing pressure. A mixed resin comprising polyethylene, polyethylene glycol macro acrylate and optionally trimethylolpropane triacrylate can be used for the second binder 13 in the present invention. Here, the polyethylene's degree of polymerization preferably ranges from about 200 to about 700.

Figure 3:
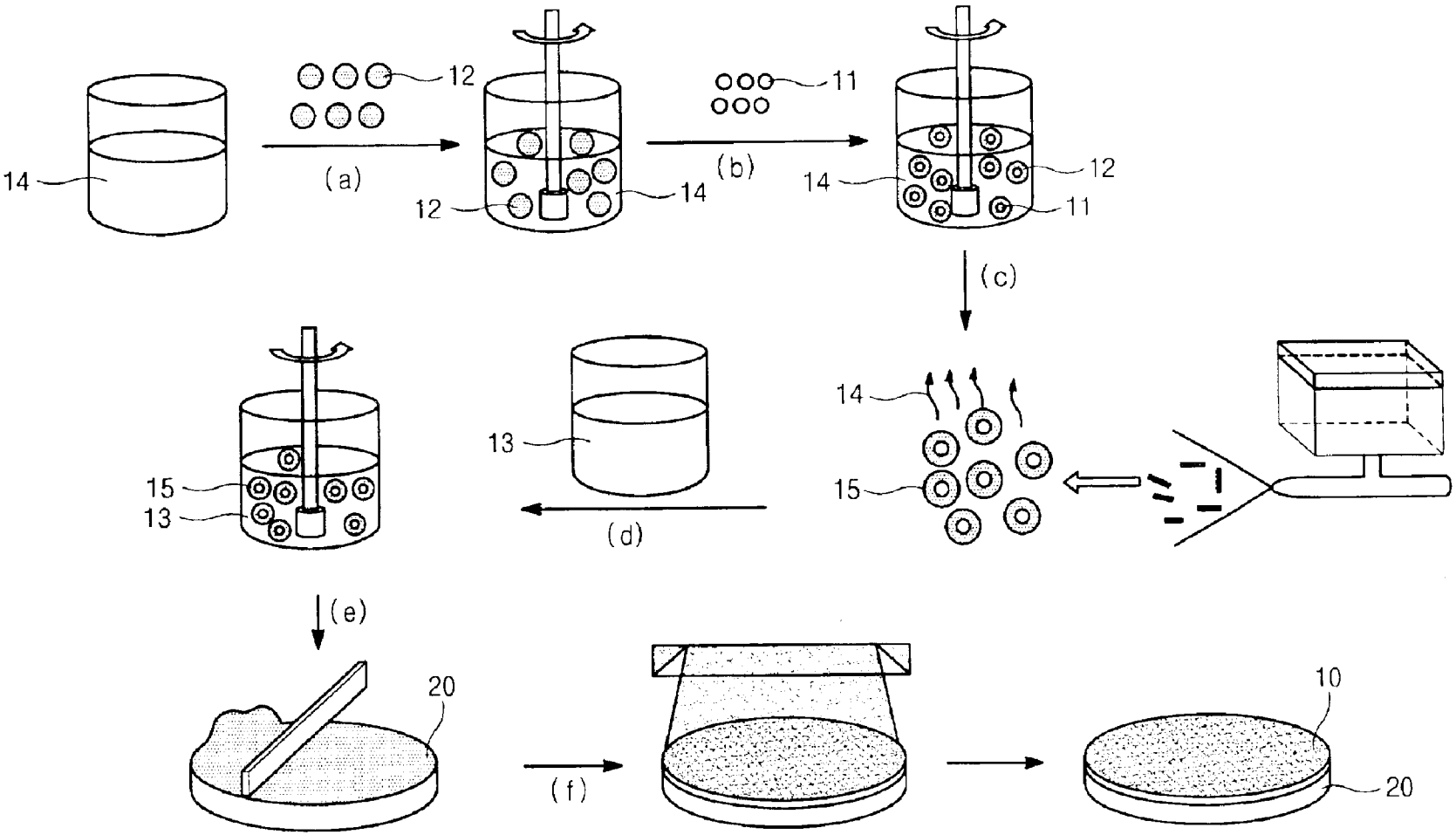
FIG. 3 schematically illustrates a manufacturing process for the polishing pad according to the disclosure.

A method of manufacturing the above polishing pad will now be described. As shown in FIG. 3, a polishing pad is manufactured by a process comprising:

(a) mixing a solvent 14 and a first binder 12 to provide a first mixture;

(b) mixing an abrasive 11 into the first mixture to provide a second mixture;

(c) removing the solvent 14 by drying the second mixture to obtain a capsulated abrasive 15;

(d) mixing the capsulated abrasive 15 and a second binder 13 to obtain a capsulated abrasive composition;

(e) coating the capsulated abrasive composition on the base pad 20 to obtain an abrasive layer 10; and (f) curing the abrasive layer 10 to obtain the completed polishing pad.

The solvent 14 and the first binder 12 are mixed in step (a). The first binder 12 is a material for capsulating the abrasive 11. As mentioned above, polyethylene glycol, polyvinyl alcohol, cellulose type resin, acrylate type resin or styrene-acrylate type resin can be used for the first binder 11.

The reason why the first binder 12 should be the resins dissolving in the etching solution is that the abrasive 11 can be released from capsule and participate in the polishing process if only the first binder 12 is dissolved in the etching solution.

And the solvent 14 is alcohol types solvent, preferably ethanol or isopropanol are used. The amount of solvent is preferably controlled with about a 6:4 ratio in [the volume of solvent 14]:[total volume of first binder 12 and abrasive 11].

Thereafter, the abrasive 11 is added into the mixing solution of the solvent 14 and the first binder 12 in the step (b). As mentioned above, fumed silica, colloidal silica, $CeO_2$, $MnO_2$ or $Al_2O_3$ are used for the abrasive 11 and the abrasive 11 is used in an amount ranging from about 5 to about 25% by weight of the first binder 12.

Polyvinyl pyrrolidone or N-vinyl-2-pyrrolidone can be further added into the mixture of the step (b) in an amount ranging from about 1 to about 10% by weight of the abrasive 11. Polyvinyl pyrrolidone or N-vinyl-2-pyrrolidone are dissolved in the etching solution such as water and alkaline solution and improves cohesiveness of the abrasives 11.

The solvent 14 is evaporated by drying to obtain the capsulated abrasive 15 in the step (c). Preferable drying method is a spray drying.

In the spray drying, liquid material is sprayed into the hot air and dried in the hot air stream in the state of fine drop below 1 mm.

The capsulated abrasive 15 obtained in the step (c) and the second binder 13 are mixed to prepare the capsulated abrasive composition in the step (d). The second binder 13 supports the capsulated abrasive 15.

As mentioned above, the second binder 13 is a mixed resin comprising polyethylene, polyethylene glycol macro acrylate and optionally trimethylolpropane triacrylate in a mixing ratio 46~60 weight %:40~46 weight %:0~6 weight %.

Polyethylene and polyethylene glycol macro acrylate improve swelling property and trimethylolpropane triacrylate controls a mechanical property and improves intensity of the second binder 13.

Thereafter, the capsulated abrasive composition is coated on the base pad 20 to obtain an abrasive layer 10 by screen-printing in the step (e), and then cured it by thermal curing, ultraviolet curing or electron beam curing according to a kind or a mixing ratio of the resin used in the step (f).

In addition, a CMP process uses the polishing pad manufactured by the above method. In the CMP process using the polishing pad, a rotating polishing pad and a wafer are contacted directly under pressure, and to the interface thereof is provided the etching solution such as a deionized water or alkaline solution.

The second binder swelled by a frictional force of the polishing pad and the wafer is not completely dissolved in the etching solution and supports the capsulated abrasive not to be lost. And the abrasive is released from capsule and participate in CMP process since the first binder have excellent solubility in the etching solution.

The CMP process using the polishing pad according to the present invention can be applied to all kind of process which polish interlayer insulating film.

As discussed earlier, CMP process is performed by using polishing pad coated with capsulated abrasive composition and providing etching solution, thereby decreasing the used amount of a conventional slurry which comprises the abrasive and the etching solution to less than 60~70%.

Moreover, it can cut costs for treating the waste solution, does not require complicated equipment for providing slurry and decrease dishing and erosion to 20~30%. As a result, process margin is improved.

What is claimed is:

1. A method of manufacturing a capsulated abrasive composition comprising:

(a) mixing a solvent with a first binder to provide a first mixture;

(b) mixing an abrasive into the first mixture to provide a second mixture;

(c) adding at least one of polyvinyl pyrrolidone or N-vinyl-2-pyrrolidone to the second mixture;

(d) removing the solvent by drying the second mixture to obtain a capsulated abrasive; and (e) mixing the capsulated abrasive with a second binder.

2. The method according to claim 1, wherein the abrasive used in step (b) is present in an amount ranging from about 5 to about 25% by weight of the first binder.

3. The method according to claim 1, wherein the first binder is selected from the group consisting of polyethylene glycol, polyvinyl alcohol, cellulose resin, acrylate resin, styrene-acrylate resin and mixtures thereof.

4. The method according to claim 1, wherein the abrasive is selected from the group consisting of fumed silica, colloidal silica, $CeO_2$, $MnO_2$, $Al_2O_3$ and mixtures thereof.

5. The method according to claim 1, wherein the second binder is a mixed resin comprising polyethylene and polyethyleneglycol macro acrylate.

6. The method according to claim 1, wherein the drying is performed by spray drying.

7. A method of manufacturing a polishing pad comprising:

(a) coating a capsulated abrasive composition prepared by the method of claim 1 onto a base pad to obtain an abrasive layer; and (b) curing the abrasive layer to obtain a polishing pad.

8. The method according to claim 7, wherein the capsulated abrasive composition is coated by screen-printing.

9. The method according to claim 7, wherein the abrasive layer is cured by a process selected from the group consisting of thermal curing, ultraviolet curing and electron beam curing.

10. The method according to claim 5 wherein the second binder further comprises trimethylolpropane triacrylate.

11. The method according to claim 10, wherein the second binder has the mixture ratio in the range of 46~60 weight %:40~46 weight %:0~6 weight % in polyethylene:polyethylene glycol macro acrylate:trimethylolpropane triacrylate.

* * * * *